US006871593B2

(12) United States Patent
Knopf et al.

(10) Patent No.: US 6,871,593 B2
(45) Date of Patent: Mar. 29, 2005

(54) METHOD FOR CONTROLLING A PRINTING PRESS

(75) Inventors: Eric Knopf, Heidelberg (DE); Stefan Schreiber, Edingen-Neckarhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 134 days.

(21) Appl. No.: 10/347,103

(22) Filed: Jan. 17, 2003

(65) Prior Publication Data

US 2003/0140808 A1 Jul. 31, 2003

(30) Foreign Application Priority Data

Jan. 21, 2002 (DE) ..... 102 02 255

(51) Int. Cl.[7] ..... B41L 39/00
(52) U.S. Cl. ..... 101/483; 101/484
(58) Field of Search ..... 101/483, 484, 101/183

(56) References Cited

U.S. PATENT DOCUMENTS

| | | | | |
|---|---|---|---|---|
| 5,615,609 A | * | 4/1997 | Hill et al. | 101/183 |
| 5,865,120 A | | 2/1999 | Gross | 101/483 |
| 5,988,063 A | | 11/1999 | Brandenburg et al. | 101/219 |
| 6,095,043 A | | 8/2000 | Hartmann et al. | 101/183 |
| 6,401,620 B1 | | 6/2002 | Buck et al. | 101/484 |

FOREIGN PATENT DOCUMENTS

| | | |
|---|---|---|
| DE | 4042275 | 7/1992 |
| DE | 4228506 | 3/1994 |
| DE | 4412945 | 10/1995 |
| DE | 19636987 | 3/1998 |
| DE | 19708985 | 10/1998 |
| DE | 19716943 | 11/1998 |
| DE | 19740153 | 3/1999 |
| DE | 19742461 | 4/1999 |
| DE | 19826338 | 4/1999 |
| DE | 19914627 | 10/2000 |
| DE | 10036721 | 2/2002 |
| GB | 2270035 | 3/1994 |
| JP | 11268250 | 10/1999 |

OTHER PUBLICATIONS

Manual: Mannesmann Rexroth "SYNAX Dezentrales System zur Synchronisierung von Maschinenachsen"(with English translation).

* cited by examiner

*Primary Examiner*—Charles H. Nolan, Jr.
(74) *Attorney, Agent, or Firm*—Davidson, Davidson & Kappel, LLC

(57) ABSTRACT

A method for controlling a drive (3) of a first subsystem of a printing press (1) which is mechanically decoupled from a second subsystem of the printing press (1). In the method, a motion sequence is determined for the second subsystem in advance, the motion sequence being used as a reference curve for controlling the drive (3) of the first subsystem.

21 Claims, 3 Drawing Sheets

METHOD FOR CONTROLLING A PRINTING PRESS

Priority to German Patent Application No. 102 02 255.0, filed Jan. 21, 2002 and hereby incorporated by reference herein, is claimed.

BACKGROUND INFORMATION

The present invention relates to a method for controlling a printing press.

In a printing press, a plurality of cylinders are set into rotation during the printing operation. Since the printing of a printing substrate takes place in a continuous process during which the printing substrate sequentially passes the individual cylinders, the rotary motions of the cylinders have to be synchronized. This is generally also true for cylinders which do not come directly in contact with the printing substrate, such as the ink transfer cylinders. The synchronization of the individual cylinders is often accomplished by providing a single drive motor which, via mechanical coupling means, such as shafts, gear wheels, chains and couplings, drives all cylinders to be driven.

The mechanical coupling of the individual cylinders results in a vibratory system having a very complex structure so that a complicated pattern of vibratory motions is superimposed on the rotary motions of the cylinders. The vibratory motions can have a negative influence on the print quality. The negative influence has a particularly strong effect if the printing press contains at least one cylinder which is, completely or partially, mechanically and thus vibrationally decoupled from the remaining cylinders of the printing press and is provided with a separate drive so that the printing press is composed of a first and a second subsystem. The second subsystem performs the already mentioned vibration pattern whereas the first subsystem possibly does not vibrate or only slightly vibrates, or does not vibrate in sync with the second subsystem. This can result in a relatively abrupt transition in the vibratory motion between adjacent cylinders of the two subsystems.

There are already known different measures which are intended to reduce the negative effects of the machine vibrations or to ensure a good synchronization of the components of the printing press. For example, German Patent Application No. 197 40 153 A1 describes a printing press which has a plurality of electric motors, each motor driving a subsystem of the printing press. The actual angular velocity of each electric motor is controllable by a separate control circuit, respectively. The control circuit contains an observer which obtains an observed nominal load torque and an observed nominal angular velocity for the control from the actual angular velocity or the actual angle of rotation and the nominal torque of the respective electric motor.

German Patent Application No. 42 28 506 A1 discloses a method and a drive for a printing press having a plurality of printing units, the printing units being coupled to each other via a gear train and each printing press unit being associated with a drive motor which supplies power to the gear train. The first drive motor supplies a surplus of power to the gear train, ensuring a constant direction of the power flow in the gear train. The last drive motor compensates for the surplus of power.

German Patent Application No. 44 12 945 A1 describes a device for damping mechanical vibrations of printing machines, in which at least one vibration pick-up controls at least one actuating member in such a manner that the vibrations detected by the vibration pick-up are damped.

German Patent Application No. 197 42 461 A1 discloses a device and a method for driving printing presses using a plurality of motors which are arranged in a decoupled manner. In order to synchronize a plurality of printing unit groups that are each provided with a separate drive motor, in each case at least one transfer station having a separately controllable drive is provided between the printing unit groups. Through the transfer station, phase synchronism is first established with respect to the printing unit group arranged upstream of the transfer station and then with respect to the printing unit group arranged downstream thereof.

German Patent Application No. 198 26 338 A1 discloses a drive system for a printing press having a plurality of printing units which are provided with separate drives. In order to synchronize the gripper bridges during sheet transfer between the printing units, provision is made for a regulating device by which the phase relation of the machine-related fluctuations in the circumferential speed of the gripper bridges is measured and shifted in such a manner that a maximum correspondence in terms of location and time is accomplished during sheet transfer. Generally, the synchronization of the adjacent gripper bridges is limited to the moment of sheet transfer because optimization is carried out specifically for this moment.

German Patent Application No. 199 14 627 A1 describes a method and a device for compensating for rotational vibrations of a printing press. The excitation of vibrations is compensated for through the superposition of counter-torques. The counter-torques are superimposed at a location of the drive train of the printing press where one of the natural modes of the printing press is unequal to zero. In this context, the counter-torques are superimposed in such a manner that the vibration is maximally reduced.

Depending on the specific conditions, the known methods and devices already yield good results. However, the strongly varying excitation torques, which are frequently to be observed in printing presses and which place very high demands on the dynamics of the measures provided, generally create problems.

BRIEF SUMMARY OF THE INVENTION

An object of the present invention is to control in as optimum a manner as possible a drive of a first subsystem of a printing press which is, at least temporarily, mechanically decoupled from a second subsystem of the printing press.

The method according to the present invention for controlling a drive of a first subsystem of a printing press which is, at least at some times, mechanically decoupled from a second subsystem of the printing press has the feature that a motion sequence is determined for the second subsystem in advance, the motion sequence being composed of a basic motion sequence and an additional motion sequence and used as a reference curve for controlling the drive of the first subsystem. This has the advantage that the motion sequences of the first and second subsystems can be very accurately synchronized or else be correlated in a different way. A synchronization of the two motion sequences takes place at least over time intervals or during periods in time. In spite of the mechanical decoupling of the two subsystems and the generally different vibration behaviors, this control of the drive of the first subsystem allows very accurate synchronization with the motion sequence of the second subsystem at all times.

It is particularly advantageous if the motion sequence composed of a basic motion sequence and an additional motion sequence is determined for the second subsystem in advance with the aid of a model. A model takes into account, inter alia, the geometry and the mechanical properties of the printing press. The basic motion sequence can correspond to the desired motion sequence of the second subsystem; in particular, for example, it can be uniform. The additional motion sequence can correspond to an undesired superimposed motion sequence of the second subsystem; in particular, for example, it can be the superimposed vibrations of the subsystem.

Since the complexity of the motion sequence of the second subsystem is essentially caused by the vibration behavior thereof, a systematic and expedient way of characterizing the motion sequence is to determine natural modes of vibrations (the spectrum or the basis of the natural modes) to a selectable order for the second subsystem in advance, and to determine characteristics of vibrational amplitudes which are associated with the respective natural modes and form the basis on which the motion sequence can be reconstructed. In other words, the additional motion sequence superimposed on the basic motion sequence can be represented by a breakdown into natural modes of vibrations to an order required to achieve a selectable precision. Moreover, this has the advantage that the particular desired accuracy can be easily adjusted through the selection of the order that is still to be considered. It is clear that the natural modes of vibrations can be the natural modes of vibrations of the overall system, of the first or second subsystems, or even of a part of the subsystems. In other words, the spectrum or the basis on which a breakdown is carried out is selectable. A preferred selection of the natural modes will be determined, inter alia, by the convergence behavior of the representation of the additional motion sequence in natural modes.

In the preferred embodiment, the reference curve is modified as a function of the current operating condition of the printing press. In this context, the reference curve can be modified as a function of a current value of a characteristic operating condition, such as the temperature, of the printing press. It is also possible for the reference curve to be alternatively or additionally modified as a function of the current motion sequence of the second subsystem. A further variant is to modify the reference curve as a function of an average value for the current motion sequence of the second subsystem. Taking into account the current operating condition advantageously allows the drive to be controlled in a very reliable and precise manner. The method automatically adapts to the respective prevailing operating situation and is also able to automatically process changes in the printing press to a certain degree.

The drive of the first subsystem is preferably controlled in such a manner that the first subsystem simulates the reference curve, i.e., that the first subsystem moves in sync with the second subsystem. To this end, the reference curve can be fed as a setpoint signal to a regulating device which controls the drive of the first subsystem. In this context, a very beneficial effect is obtained when the setpoint signal precedes the current motion sequence of the second subsystem by a selectable phase difference. The precedence in time gained through the phase difference can be used to carry out the input from the reference curve almost without delay and with high precision and, in fact, even if the reference curve exhibits high dynamics. With regard to this, it is also an advantage if the regulating device contains a precontrol and a controller which are each fed with the setpoint signal, a coarse control of the drive of the first subsystem being carried out by the precontrol and a fine control of the drive of the first subsystem being carried out by the controller. In other words, the precontrol allows high dynamics and the controller permits high precision. In order to form a closed-loop control circuit, the controller can be fed with an actual-value signal characterizing the current motion sequence of the first subsystem.

The first subsystem and the second subsystem can each have at least one rotating component. In this case, the motion sequence of the first subsystem and the motion sequence of the second subsystem can each be represented by the profile of an angular velocity characterizing the respective subsystem or by a variable associated therewith. In particular, it is possible to use the respective time history of the angular velocities or of the variables associated therewith. However, it is also possible to use the respective profile of the angle of rotation, the angular velocities, or the variables associated therewith.

BRIEF DESCRIPTION OF THE DRAWINGS

In the following, the present invention will be explained in greater detail in the light of the exemplary embodiment shown in the drawing, in which.

DETAILED DESCRIPTION

Figure 1:
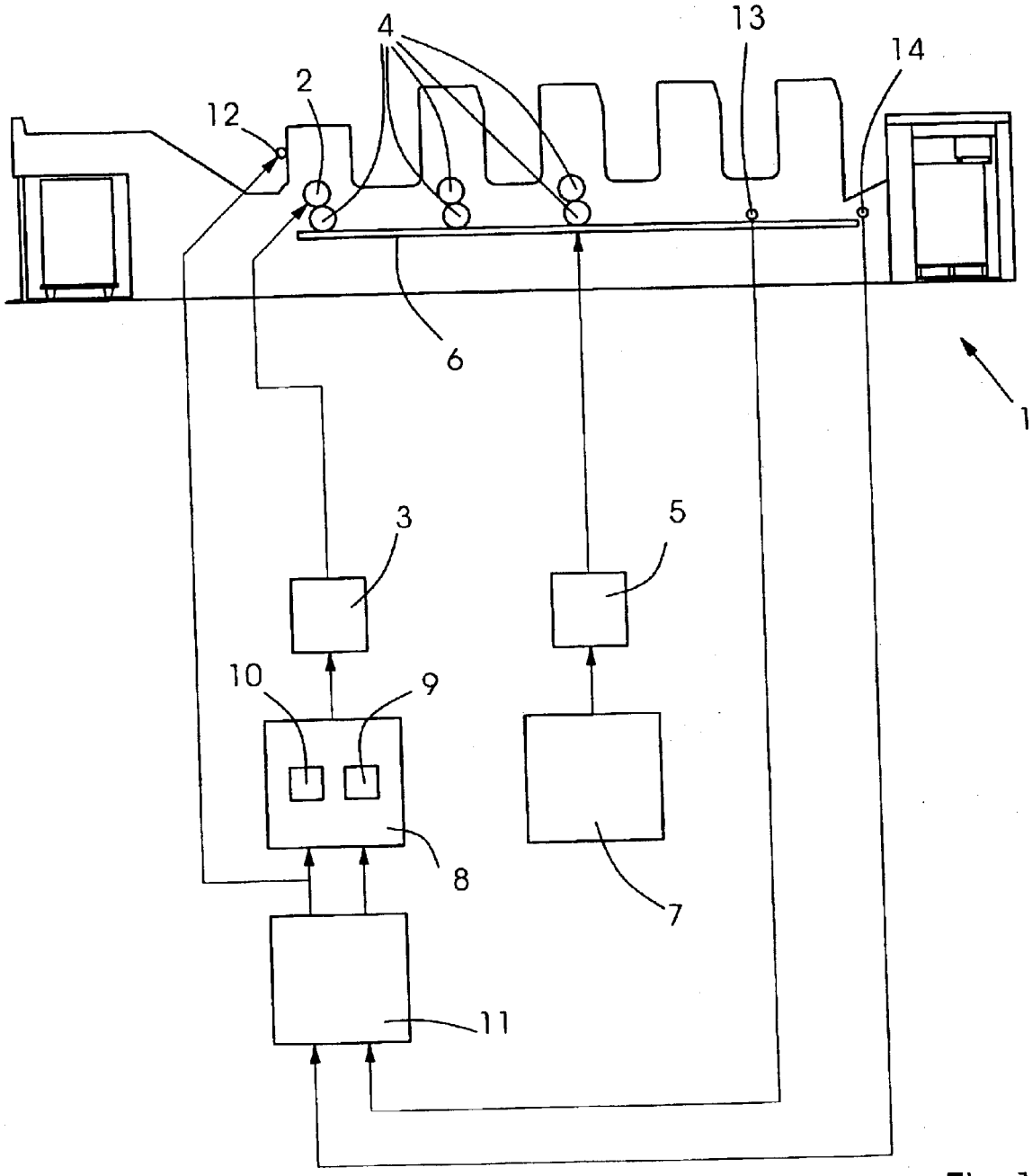
FIG. 1 shows a schematic representation of a printing press, including components which are relevant in the context of the method according to the present invention.

FIG. 1 is a schematic representation of a printing press 1, including components which are relevant in the context of the method according to the present invention. Printing press 1 is composed of two subsystems which each feature a separate drive device. The first subsystem has a cylinder 2 which is driven by a first drive motor 3. Depending on the form of construction, it is also possible for drive motor 3 to drive a plurality of cylinders 2. The second subsystem contains a number of cylinders 4 which are mechanically coupled to each other and driven together by a second drive motor 5. The mechanical coupling of cylinders 4 of the second subsystem is symbolically indicated by a line 6 and can be implemented, for example, by a gear train. The gear train, on one hand, allows all cylinders 4 of the second subsystem to be driven by the same drive motor 5 and, on the other hand, ensures that the rotary motions of cylinders 4 of the second subsystem are performed in sync with each other within the bounds of the mechanical precision of the gear train. At least at some times, there is no mechanical coupling between cylinder 2 of the first subsystem and cylinders 4 of the second subsystem.

Second drive motor 5 is controlled via a control unit 7 which is known per se and is not the subject matter of the present invention. Therefore, the design and mode of operation of control unit 7 are not explained in greater detail. First drive motor 3 is controlled using a regulating device 8 containing a precontrol 9 and a controller 10. Regulating device 8 has two inputs one of which is connected to the output of a functional unit 11 for generating a setpoint signal and the other of which is connected to the output of a first incremental encoder 12 for measuring the angular velocity of cylinder 2 of the first subsystem. Functional unit 11 has two inputs. A first input is connected to the output of a temperature sensor 13 located on printing press 1. A second input is connected to the output of a second incremental encoder 14 for measuring the angular velocity of and the absolute angular position of one of cylinders 4 of the second subsystem.

Since cylinders 4 of the second subsystem of printing press 1 are mechanically connected to each other, they form a vibratory system which, in particular, also performs rotational vibrations. As a result of this, cylinders 4 of the second subsystem do not rotate at exactly constant angular velocity due to the superimposed rotational vibrations even when second drive motor 5 generates, with high precision, a rotary motion with constant angular velocity. Since the geometry of printing press 1 and the occurring forces and torques are known, it is possible to calculate the arising vibrations. In order to characterize the vibration behavior, it is sufficient to analyze the conditions for one or, at most, a few revolutions of cylinders 4 of the second subsystem because the conditions will then recur. In this context, it is recommendable to break down the overall vibration of the second subsystem of printing press 1 into the underlying natural modes and to determine the amplitudes with which the individual natural vibrations occur, respectively. The result of such an analysis is shown in FIG. 2.

Figure 2:
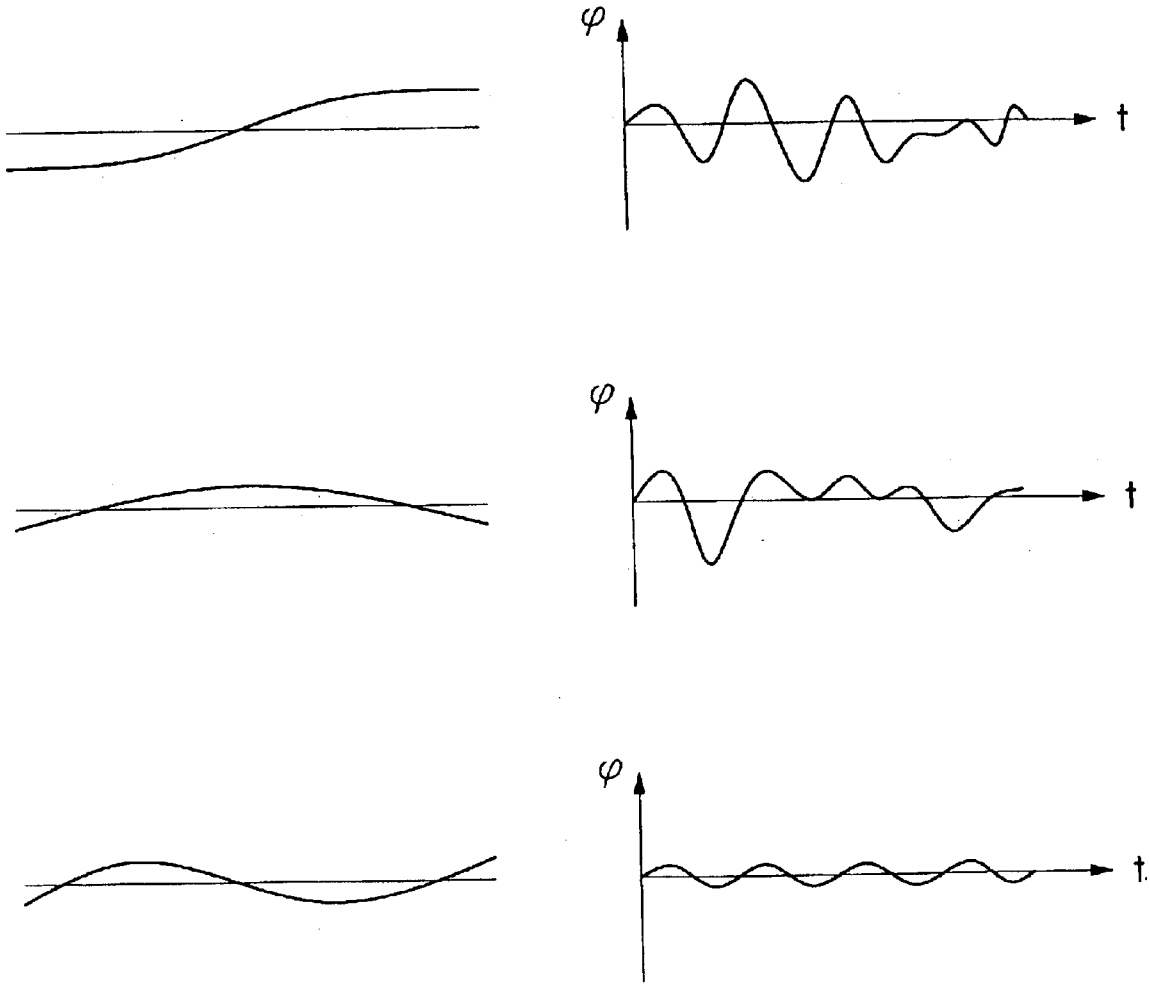
FIG. 2 shows a representation of three natural modes (on the left) of the vibratory motion of a printing press, including the respective associated time history of the amplitude (on the right)

FIG. 2 shows a representation of three natural modes (on the left) of the vibratory motion of the second subsystem of a printing press 1, including the respective associated time history of the amplitude, in which the amplitude $\phi$ of the natural mode is in each case plotted over time (on the right). There are shown the natural mode of first order at the very top, the natural mode of second order in the middle, and the natural mode of third order at the bottom. Each natural mode corresponds to a fundamental mode of the second subsystem, the sorting being carried out such that the associated natural frequency increases with the order of the natural mode, as usual. The natural mode of the zero order (not shown) of rotational vibrations corresponds to a rotation at constant angular velocity. In order to accurately describe the vibration behavior of the second subsystem, one would, in principle, have to take into account all excited natural modes. However, as can be seen from FIG. 2, the maximum amplitude of the natural modes decreases very rapidly with increasing order so that the vibration behavior of the second subsystem can already be described to a very good approximation using a few natural modes. The criterion for the order to which the natural modes are to be considered can be provided, for example, by selecting a lower limit for the maximum amplitude that needs to be exceeded in order for the associated natural mode to be taken into account. In order to determine the overall vibration of the second subsystem, all natural vibrations meeting this criterion are superimposed according to their amplitude characteristics. If the natural mode of the zero order is also taken into account, then this yields the time history of the angular velocity for cylinders 4 of the second subsystem.

Figure 3:
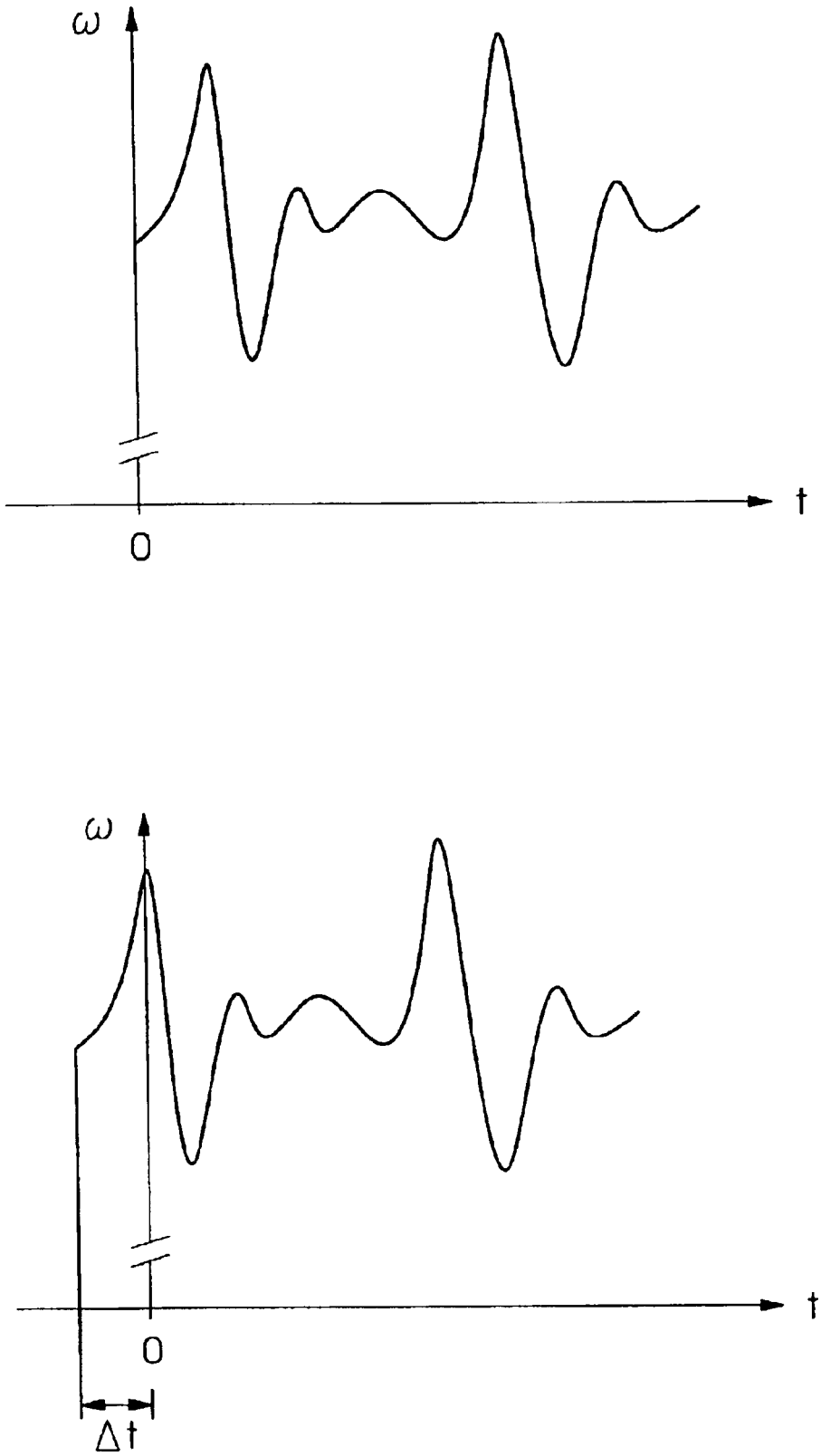
FIG. 3 depicts a diagram of the actual time history of the angular velocity of a cylinder of a printing press (at the top) and a diagram of the time history of the setpoint value of the angular velocity that is used in the control according to the present invention of a further cylinder (at the bottom).

FIG. 3 depicts a diagram of the actual time history of the angular velocity of cylinder 4, which belongs to the second subsystem and is adjacent to cylinder 2 of the first subsystem (at the top), and a diagram of the time history of the setpoint value of the angular velocity that is used in the control according to the present invention of drive motor 3 of cylinder 2 of the first subsystem (at the bottom). In the diagrams, angular velocity $\omega$) is in each case plotted over time t. Time t and the machine angle $\Phi$ have a simple relation to each other so that a representation of angular velocity $\omega$ over the machine angle $\Phi$ is equivalent. The curves plotted in the two diagrams nearly coincide with respect to their shape. However, the curves are shifted relative to each other by a time interval $\Delta t$, i.e., regulating device 8, which controls first drive motor 3 for driving cylinder 2, is fed with a setpoint signal which in its time history, except for a shift $\Delta t$, approximately corresponds to the actual profile of the angular velocity of adjacent cylinder 4 that is driven by second drive motor 5. The equivalent applies to an angular difference in the machine angle $\Delta\Phi$ as well. The following is an explanation of why such a setpoint signal is used and of how the setpoint signal can be determined.

In principle, first drive motor 3 could be controlled in a completely equivalent manner as second drive motor 5. In this case, however, due to the different vibration behavior of cylinder 2 of the first subsystem, an angular velocity profile would result for this cylinder which would be different from the angular velocity profile of adjacent cylinder 4 of the second subsystem, which is shown in the upper diagram of FIG. 3, of the second subsystem. This would mean that the motion of cylinder 2 of the first subsystem would not or not precisely be synchronized with the motion of adjacent cylinder 4 of the second subsystem. This poor correspondence of the motion sequences is remedied according to the present invention in that the time history of the angular velocity that has been determined in advance for cylinder 4 adjacent to cylinder 2 is used for controlling first drive motor 3. Specifically, the second subsystem of printing press 1 is previously simulated for that purpose using a suitable model. With the aid of the model, for example, the time history of the angular velocity is determined for cylinder 4 adjacent to cylinder 2 and stored in a memory of functional unit 11. In this context, it is generally sufficient to store the angular velocity profile for the period of a few revolutions, at least of one revolution of cylinder 4, since the angular velocity profile recurs periodically. During the operation of printing press 1, the stored data is used as a reference curve for controlling first drive motor 3. Preferably, the reference curve is stored as a function of machine angle $\Phi$.

To achieve as high an accuracy as possible, the reference curve is in each case modified as a function of the current operating condition of printing press 1. This modification is carried out by functional unit 11. Since the formation of the vibrations of the second subsystem of printing press 1 depends, for example, on the rotational speeds of cylinders 4, the reference curve is modified as a function of the current average angular velocity of one of cylinders 4 of the second subsystem. Moreover, when printing press 1 is operated at different speeds of rotation, it is required for the machine angle scale to be stretched or compressed according to the reference curve, respectively, because the period for one revolution has different times at different speeds. Moreover, the reference curve is modified as a function of the current operating temperature of printing press 1, which is measured by temperature sensor 13. Since the temperature can take different values at different locations of printing press 1, the measuring position is selected such that a characteristic operating condition, such as a characteristic temperature, is determined which is suitable for the modification of the reference curve. Finally, the reference curve is modified as a function of the current profile of the angular velocity of one of cylinders 4 of the second subsystem. This profile can be determined from the data measured by second incremental encoder 14 and allows the reference curve to be finely adapted to the actual conditions. Depending on the specific application case and the desired accuracy, the modification of the reference curve can also be completely of partially dispensed with.

In order to generate from the reference curve a setpoint signal for regulating device 8 shown in FIG. 1, it is further required to adjust the phase to the current operating condition of printing press 1, i.e., the reference curve must be shifted along the time axis. To this end, first of all, the phase angle of the rotary motion of cylinder 4, which belongs to the second subsystem and is adjacent to cylinder 2 of the first subsystem, is measured. This can be carried out by means of second incremental encoder 14 which outputs a signal for the absolute angular position once per revolution. The angular velocity profile of cylinder 4, which belongs to the second subsystem and is adjacent to cylinder 2 of the first subsystem, is stored in such a manner that the time zero point corresponds to the absolute angular position measured by second incremental encoder 14. Consequently, the time zero point of the reference curve corresponds to the measured angular position as well. Thus, the phase adjustment can be carried out by aligning the time zero point of the reference curve relative to the point in time at which second incremental encoder 14 outputs the signal for the absolute angular position. In this context, it would in principle be possible to make the reference curve coincide with respect to its phase angle with the curve in the upper diagram of FIG. 3. However, it has turned out that cylinder 2 of the first subsystem can be synchronized with higher precision by adjusting the phase angle in such a manner that the reference curve precedes the actual profile of the angular velocity of cylinder 4 adjacent to cylinder 2 by time interval $\Delta t$. A reference curve that has been shifted in phase in such a manner is depicted in the lower diagram of FIG. 3 and is sent by functional unit 11 to regulating device 8 as a setpoint signal. Due to the phase shift, in conjunction with precontrol 9, it is possible to simulate the setpoint values very precisely even if the setpoint signal changes very rapidly because the profile of the setpoint signal reflects the future conditions and drive motor 3 can therefore be controlled in a timely and optimum manner. As a result of this, only comparably small control deviations need to be corrected by controller 10, thus allowing controller 10 to be optimized for high precision. Altogether, a fast, very precise and reliable control of first drive motor 3 is achieved in this manner.

A further exemplary embodiment does not use the time history of the angular velocity but works with a profile of the angle of rotation. Furthermore, instead of the angular velocity, other variables which are associated with the angular velocity can also be used, such as the deviation of the angular velocity from a reference value, or the angular position, or the angular acceleration.

| List of Reference Numerals | |
|---|---|
| 1 | printing machine |
| 2 | cylinder (first subsystem) |
| 3 | first drive motor |
| 4 | cylinder (second subsystem) |
| 5 | further drive motor |
| 6 | mechanical coupling |
| 7 | control unit |
| 8 | regulating device |
| 9 | precontrol |
| 10 | controller |
| 11 | functional unit for generating a setpoint signal |

-continued

| List of Reference Numerals | |
|---|---|
| 12 | first incremental encoder |
| 13 | temperature sensor |
| 14 | second incremental encoder |

What is claimed is:

1. A method for controlling a drive of a first subsystem of a printing press, the first subsystem being at least at some times mechanically decoupled from a second subsystem of the printing press, the printing press having a drive for the first subsystem, the method comprising the steps of:

determining a motion sequence for the second subsystem in advance, the motion sequence being composed of a basic motion sequence and an additional motion sequence; and controlling the drive of the first subsystem using a reference curve, the reference curve being a function of the motion sequence.

2. The method as recited in claim 1 wherein the motion sequence is determined for the second subsystem in advance using a model.

3. The method as recited in claim 1 wherein the determining step includes determining natural modes of vibrations to a selectable order for the second subsystem in advance, characteristics of vibrational amplitudes associated with the respective natural modes forming the basis for the controlling step.

4. The method as recited in claim 1 further comprising modifying the reference curve as a function of a current operating condition of the printing press.

5. The method as recited in claim 4 wherein the reference curve is modified as a function of a current value of a characteristic temperature of the printing press.

6. The method as recited in claim 4 wherein the reference curve is modified as a function of a current motion sequence of the second subsystem.

7. The method as recited in claim 4 wherein the reference curve is modified as a function of an average value for a current motion sequence of the second subsystem.

8. The method as recited in claim 1 wherein the drive of the first subsystem is controlled in such a manner that the first subsystem simulates the motion sequence of the second substystem.

9. The method as recited in claim 1 wherein the controlling step includes feeding the reference curve as a setpoint signal to a regulating device controlling the first subsystem.

10. The method as recited in claim 9 wherein the setpoint signal precedes a current motion sequence of the second subsystem by a selectable phase difference.

11. The method as recited in claim 9 wherein the regulating device includes a precontrol and a controller, each being fed with the setpoint signal, a coarse control of the drive of the first subsystem being carried out by the precontrol and a fine control of the drive of the first subsystem being carried out by the controller.

12. The method as recited in claim 11 wherein the controller is fed with an actual-value signal characterizing a current motion sequence of the first subsystem.

13. The method as recited in claim 1 wherein the first subsystem and the second subsystem each have at least one rotating component.

14. The method as recited in claim 13 wherein a further motion sequence of the first subsystem and the motion sequence of the second subsystem are each represented by a profile of an angular velocity characterizing the respective first or second subsystem or by a variable associated with the profile.

15. The method as recited in claim 14 wherein the profile is in each case a time history.

16. The method as recited in claim 14 wherein the profile is in each case a profile of an angle of rotation.

17. The method as recited in claim 1 wherein the second subsystem is downstream from the first subsystem.

18. The method as recited in claim 2 wherein the model is a function of geometry and mechanical properties of the printing press.

19. The method as recited in claim 1 wherein the determining of the motion sequence includes driving the second subsystem at a desired motion sequence corresponding to the basic motion sequence and analyzing an actual motion sequence of the second subsystem, the actual motion sequence corresponding to the motion sequence.

20. The method as recited in claim 19 wherein the actual motion sequence is analyzed for a period of time corresponding to at least one revolution of a cylinder of the second subsystem.

21. The method as recited in claim 19 wherein the desired motion sequence is a uniform motion sequence at a constant angular velocity.

* * * * *